US008646240B1

(12) United States Patent
Patrick et al.

(10) Patent No.: US 8,646,240 B1
(45) Date of Patent: Feb. 11, 2014

(54) METHOD AND APPARATUS FOR FORMING A MAST ASSEMBLY

(75) Inventors: Charles Patrick, Tomball, TX (US); Chris Post, Tomball, TX (US)

(73) Assignee: NRG Manufacturing, Tomball, TX (US)

( * ) Notice: Subject to any disclaimer, the term of this patent is extended or adjusted under 35 U.S.C. 154(b) by 67 days.

(21) Appl. No.: 13/226,830

(22) Filed: Sep. 7, 2011

Related U.S. Application Data

(60) Provisional application No. 61/380,599, filed on Sep. 7, 2010.

(51) Int. Cl.
*E21B 19/00* (2006.01)

(52) U.S. Cl.
USPC ..... 52/651.05; 52/632; 52/114; 166/85.1

(58) Field of Classification Search
USPC ..... 166/77.51, 85.1; 173/184; 29/897.3, 29/897.31; 52/745.17, 113–115, 632, 52/651.05
See application file for complete search history.

(56) References Cited

U.S. PATENT DOCUMENTS

| | | | | | |
|---|---|---|---|---|---|
| 926,925 | A * | 7/1909 | Carmony | 52/123.1 |
| 1,644,499 | A * | 10/1927 | Trout | 52/123.1 |
| 4,231,200 | A * | 11/1980 | Henderson | 52/111 |
| 4,885,893 | A * | 12/1989 | Wasterval et al. | 52/745.18 |
| 5,216,867 | A * | 6/1993 | Wasterval et al. | 52/745.17 |
| 5,450,695 | A * | 9/1995 | Desai | 52/118 |
| 5,490,364 | A * | 2/1996 | Desai et al. | 52/637 |
| 6,951,082 | B2 * | 10/2005 | Nelson et al. | 52/112 |
| 7,828,086 | B2 * | 11/2010 | Lesko | 175/203 |
| 8,353,132 | B1 * | 1/2013 | Vogt et al. | 52/123.1 |

* cited by examiner

*Primary Examiner* — Robert Canfield
*Assistant Examiner* — Brent W Herring
(74) *Attorney, Agent, or Firm* — Egbert Law Offices, PLLC

(57) ABSTRACT

A method and apparatus for forming a mast assembly upon a floor of a drilling rig has a support structure, a first carriage assembly affixed to one side of the support structure and a second carriage assembly affixed to an opposite side of the support structure. Each of the first and second carriage assemblies are connectable to a section of the mast assembly. Drive cylinders are associated with the first and second carriage assemblies so as to cause the section of the mast assembly to move upwardly relative to the support structure. While the section of the mast assembly is retained in an elevated position, another section of the mast assembly can be placed within the support structure and joined to the elevated mast section. Additional mast sections can be connected together in a similar manner.

8 Claims, 10 Drawing Sheets

METHOD AND APPARATUS FOR FORMING A MAST ASSEMBLY

CROSS-REFERENCE TO RELATED APPLICATIONS

The present application claims priority from U.S. Provisional Patent Application Ser. No. 61/380,559, filed on Sep. 7, 2010, and entitled "Method and Apparatus for Forming a Mast Assembly".

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to mast assemblies of drilling rigs. More particularly, the present invention the relates to "boot strap" types of rig assemblies. More particularly, the present invention relates to the formation of mast assemblies in which sections of the mast assembly are installed vertically in end-to-end relation.

2. Description of Related Art

Including Information Disclosed Under 37 CFR 1.97 and 37 CFR 1.98.

Conventional oil drilling in exploration in major land drilling operations require the rapid deployment, assembly and disassembly of drilling structures. Consequently, the transportability of components and the speed at which components can be assembled with a minimum amount of auxiliary equipment are paramount concerns. A transportable oil drilling rig typically includes, for example, a support base, a mast, pipe sections, and a drill floor. Often times, however, auxiliary equipment, such as cranes, are required to facilitate the set-up and take-down of large components such as the base, the drill floor, the pipe racking boards, and the mast. This has the effect of increasing operational costs.

Drilling sites are often located in remote areas requiring truck transportation of the components of the rig accompanied by equipment used to assemble the rig. Further complicating the rig assembly process is the persistent need to change locations once a hole is sunk and it is determined whether the site will be sufficiently productive to merit a pumping installation, whether the site will be unproductive, or whether a more ideal location exists to sink a hole. Typically, site changes can occur once every several months and, in response, prior art systems have attempted to increase the degree of mobility of rig components.

Since the variable costs associated with leased support equipment, such as the cranes and the like, are calculated on the per hour or day basis, expediting the takedown, transport and set-up operations is crucial for minimizing equipment leasing costs. Typical takedown and setup time is in the order of days. With equipment leasing costs ranging from several hundred dollars per day or more, many thousands of dollars in cost may be incurred for each end of a setup and takedown operation. For larger or more complex rigs, the cost may be even higher. In general, prior art drilling rigs are geared for facilitating rapid setup, takedown and transport but still require external cranes, external winches, and the like which are most often leased so as to increase overall expense.

In order to move a large drilling rig, including all of its equipment, from one well bore to another, it has been necessary to disassemble or "rig down" the drilling structure. This requires disconnecting all ancillary services and laying down the mast from a vertical to a horizontal position, moving the drilling structure to an alternative well bore, then reassembling the entire drill structure and reconnecting all ancillary services.

The drilling site and drilling rig may be configured in various known ways and may include various equipment. The drilling rig will often have an upstanding mast having an open face connected to the floor of the drilling rig. The mast may extend vertically forty to fifty meters or more and support a crown assembly at the top. The mast and floor are located above and are connected to an elongated substructure.

In the past, systems have been employed whereby the known truncated pyramid-shaped drilling rigs are positioned above the rig floor. In normal operation, these types of mast assemblies are assembled in a generally horizontal orientation. The various components of this type of mast assembly are supported, during assembly, by an item known as a "headache rack". As such, when each section of the mast assembly is assembled, the headache rack can be moved to the end that remains away from the rig. When the entire mast assembly has been completed, suitable cables, lines, cranes, and other equipment are required in order to pivot the mast assembly from the horizontal to the vertical position. The elevation of the rig in this manner can pose severe dangers to the safety and welfare of the workers in the area of the rig.

In the past, various patents have issued relating to the assembly of drilling rigs. For example, U.S. Pat. No. 3,996,754, issued on Dec. 14, 1976 to E. L. Lowery, shows a mobile marine drilling unit. This mobile drilling unit has a floatable base, a floatable platform, and a vertical support leg attached to said base and extending upwardly through a well provided therefor in the platform. The base and a major portion of the leg are submergible in a body of water for support on the floor thereof. The support leg and platform are provided with elevating mechanisms for elevating the platform above the body of water on the leg.

U.S. Pat. No. 4,569,168, issued on Feb. 11, 1986 to McGovney et al., provides a self-elevating substructure for a portable oil derrick. This substructure has a base frame, a top frame and an intermediate bifurcated support frame consisting of a pair of horizontally extending traveling frames. A linkage network of swingable leg members intercouples the base, traveling and top frames for movement in parallelism between collapsed and elevated conditions of the substructure. In the collapsed mode, the frame members are positioned in an adjacent relationship for presenting a low profile to a flatbed truck which allows a portable oil rig to be easily shifted onto the top frame and into alignment with the oil wellhead therebelow. A block-and-tackle assembly operably engages the traveling frames and is coupled to the derrick hook carried by the traveling block. Upon completion of the latter, the swingably mounted traveling frames move towards each other causing an elevation of the top frame so as to present a working space between the elevated oil derrick and oil wellhead. The traveling frames are locked one to the other to maintain the top frame at its elevated position with collapsible end sway braces precluding lateral shifting of the top frame and oil rig thereon.

U.S. Pat. No. 4,899,832, issued on Feb. 13, 1990 to R. C. Bierscheid, Jr., shows an automated well drilling apparatus that is transportable in modular units to a well site. The units can be rapidly assembled into an integrated operational assembly. The apparatus includes a drilling unit and two raising units that are locked to the respective opposite sides thereof. After base structures on the raising units are lowered to the ground to provide a support, the towers of the raising units and the mast of the drilling unit are simultaneously elevated to the vertical. The same raising units are then employed to erect pipe supply frames that are connected to the front of each tower.

U.S. Pat. No. 6,634,436, issued on Oct. 21, 2003 to V. Desai, provides a mobile land drilling apparatus and method. A mobile telescoping substructure box includes at least one axle and carriage assembly A lifting means selectively supports the mobile telescoping substructure box unit in a raised position and lowered position with respect to the ground. An extension cylinder further extends the mobile telescoping substructure box unit. A stationary frame member and a telescoping frame member comprising the mobile telescoping substructure box unit have a plurality of cables attached thereto for supporting the telescoping frame member when extended.

U.S. Pat. No. 7,306,055, issued Dec. 11, 2007 to R. M. Barnes, describes a method for installing a mobile drilling rig at a drilling site. This method entails transporting the mobile drilling rig to the drilling site. The mobile drilling rig is made of three sections. The two substructures are placed parallel to one another at the drilling site. The mast section is connected to the mast starting sections located on each substructure. Raising cylinders on the substructures engage the mast and raise the mast into a substantially vertical orientation. In this position, the mast is locked in place. The raising cylinders are retracted and then re-extended into a drill floor raising position.

U.S. Pat. No. 7,357,616, issued on Apr. 15, 2008 to Andrews et al., provides a method and apparatus for transporting an oil rig. The oil rig is capable of being at least partially disassembled to form at least two portions. The top portion of the oil rig can be loaded onto a trailer for transport separate from a bottom portion. The trailer includes a bottom frame, a top frame, a structure operably associated with the bottom and top frames for moving the top and bottom frames from and towards one another. There is a moving means attached to at least the bottom frame to allow the trailer to be moved along the support surface.

It is an object of the present invention to provide a method and apparatus for forming a mast assembly that avoids the use of cranes and cables in achieving proper assembly over the well.

It is another object of the present invention to provide a method and apparatus for forming a mast assembly that enhances the structural integrity of the mast assembly.

It is another object of the present invention to provide a method and apparatus for forming a mast assembly that allow the formation of mast assemblies having an elevation of 160 feet or more.

It is still another object of the present invention to provide a method and apparatus for forming a mast assembly which allows the mast assembly to be assembled in compression throughout the assembly process.

It is still another object of the present invention to provide a method and apparatus for forming a mast assembly that enhances safety conditions for workers in the area of the drilling rig.

It is still another object of the present invention to provide a method and apparatus for forming a mast assembly which minimizes the amount of material required for the formation of the mast assembly.

It is still another object of the present invention to provide a method and apparatus for forming a mast assembly which enhances the ability to efficiently and effectively assemble the mast assembly.

These and other objects and advantages of the present invention will become apparent from a reading of the attached specification and appended claims.

BRIEF SUMMARY OF THE INVENTION

The present invention is an apparatus for forming a mast assembly upon a floor of a drilling rig. This apparatus includes a support structure having a back surface and a forward opening, a first carriage assembly affixed to one side of the support structure, and a second carriage assembly affixed to an opposite side of the support structure. Each of the first and second carriage assemblies have a carriage with a drive cylinder connected thereto so as to move the carriage between a lower position and an upper position.

In this apparatus of the present invention, the support structure includes an A-frame that is suitable for connection to the floor of the drilling rig, and a boot frame positioned over the A-frame. The first and second carriage assemblies are affixed to the boot frame.

A first guide member is affixed to the back surface of the support structure. The first guide member is suitable for receiving a channel of the mast assembly thereover. The first guide member extends vertically. A second guide member is affixed to the back surface of the support structure. The second guide member extends vertically in spaced relation to the first guide member. The second guide member is suitable for receiving another channel of the mast assembly thereover. An extendable guide member is positioned adjacent the forward opening of the support structure. The extendable guide member serves to slide into a channel of the mast assembly so as to retain the mast assembly within an interior of the support structure.

Each of the first and second carriage assemblies includes an elongated beam assembly that extends vertically so as to have an upper end positioned above the support structure and a lower end positioned in spaced relation above the rig floor. This elongated beam assembly includes a first I-beam having a channel formed longitudinally therein, and a second I-beam having a channel formed longitudinally therein. The first and second I-beams are affixed to the support structure such that the respective channels thereof face each other. Each of the first and second carriage assemblies has a guide block having ends slidably received in the channels of the I-beams. The drive cylinder is connected to this guide block. A lifting carriage is affixed to the guide block and positioned outwardly of the first and second I-beams. The lifting carriage is suitable for connection to a section of the mast assembly. The lifting carriage includes a pin actuator affixed to the lifting cylinder. This pin actuator is suitable for moving a pin in a direction for connecting to the section of the mast assembly. A locking mechanism is connected to the support structure for locking the mast assembly to the support structure in an elevated position above the rig floor.

This present invention is also a method of forming a mast assembly of drilling above a rig floor. This method includes the steps of: (1) forming a support structure above the rig floor so as to have a carriage assembly on one side thereof; (2) positioning the mast assembly through the opening of the support structure and into an interior of the support structure; (3) connecting the carriage assembly to the mast assembly; (4) elevating the carriage assembly so as to move the mast assembly a desired distance above the rig floor; and (5) locking the lower portion of the mast assembly to an upper portion of the support structure. In this method of the present invention, the step of forming includes affixing a first guide member to the back surface of the support structure so as to extend vertically therealong. The step of positioning includes positioning the mast assembly such that a channel of a mast assembly receives the first guide member therein. The step of forming includes affixing an extendable guide member adjacent the opening of the support structure. The extendable guide member is movable between an elevated position and a lowered position. The step of positioning includes: (1) moving the extendable guide member to the elevated position; (2) placing the mast assembly into the interior of the support structure; and (3) moving the extendable guide member to a lower position so as to be received by a channel of the mast assembly. The carriage assembly has a drive cylinder connected thereto. This carriage assembly has a lifting carriage connected to the drive cylinder. The step of elevating includes actuating the drive cylinder so as to move the lifting carriage upwardly for a desired distance. The connection of the carriage assembly to the mast assembly is released after the step of locking.

An additional embodiment of the method of the present invention includes the forming of a mast assembly by connecting several mast sections together. This method specifically includes the steps of: (1) forming a support structure above a rig floor so as to have a carriage assembly on one side thereof; (2) positioning a first mast section into an interior of the support structure; (3) connecting the carriage assembly to the first mast section; (4) elevating the carriage assembly and the connected first mast section to a desired distance above the rig floor; (5) positioning a second mast section into the interior of the support structure; (6) affixing a bottom of the first mast section to a top of the second mast section; (7) releasing the carriage assembly from the first mast section; (8) moving the carriage assembly downwardly to a lower position adjacent the second mast section; (9) connecting the carriage assembly to the second mast section; (10) elevating the first and second mast sections to a desired distance above a rig floor; (11) positioning a third mast section into the interior of the support structure; (12) affixing a bottom of the second mast section to a top of the third mast section; (13) releasing the carriage assembly from the second mast section; (14) moving the carriage assembly downwardly to the lower position adjacent the third mast section; (15) connecting the carriage assembly to the third mast section; (16) elevating the first mast section and second mast section and the third mast section to a desired position above a rig floor; and (17) locking a bottom portion of the third mast section to an upper portion of the support structure.

In this method of present invention, the step of forming includes affixing a first elongated beam to one side of the support structure, affixing a second elongated beam to an opposite side of the support structure, slidably mounting a first carriage of the carriage assembly to the first elongated beam, slidably mounting a second carriage of the carriage assembly to the second elongated beam, connecting a first drive cylinder to the first carriage, and then connecting a second drive cylinder to the second carriage. Each of the first and second elongated beams has an upper end positioned above the support structure and a lower end positioned a distance above a rig floor. Each of the first and second carriages has a pin actuator. Each of the first mast section and the second mast section and the third mast section have a lug on a surface thereof. The pin actuator can be activated so as to cause the pin of the pin actuator to engage the lug of the respective mast section. The first drive cylinder is actuated so as to move the first carriage upwardly along the first beam. The second drive cylinder is actuated so as to move the second carriage upwardly along the second beam. The first and second carriages move correspondingly along the respective beams.

DETAILED DESCRIPTION OF THE INVENTION

Figure 1:
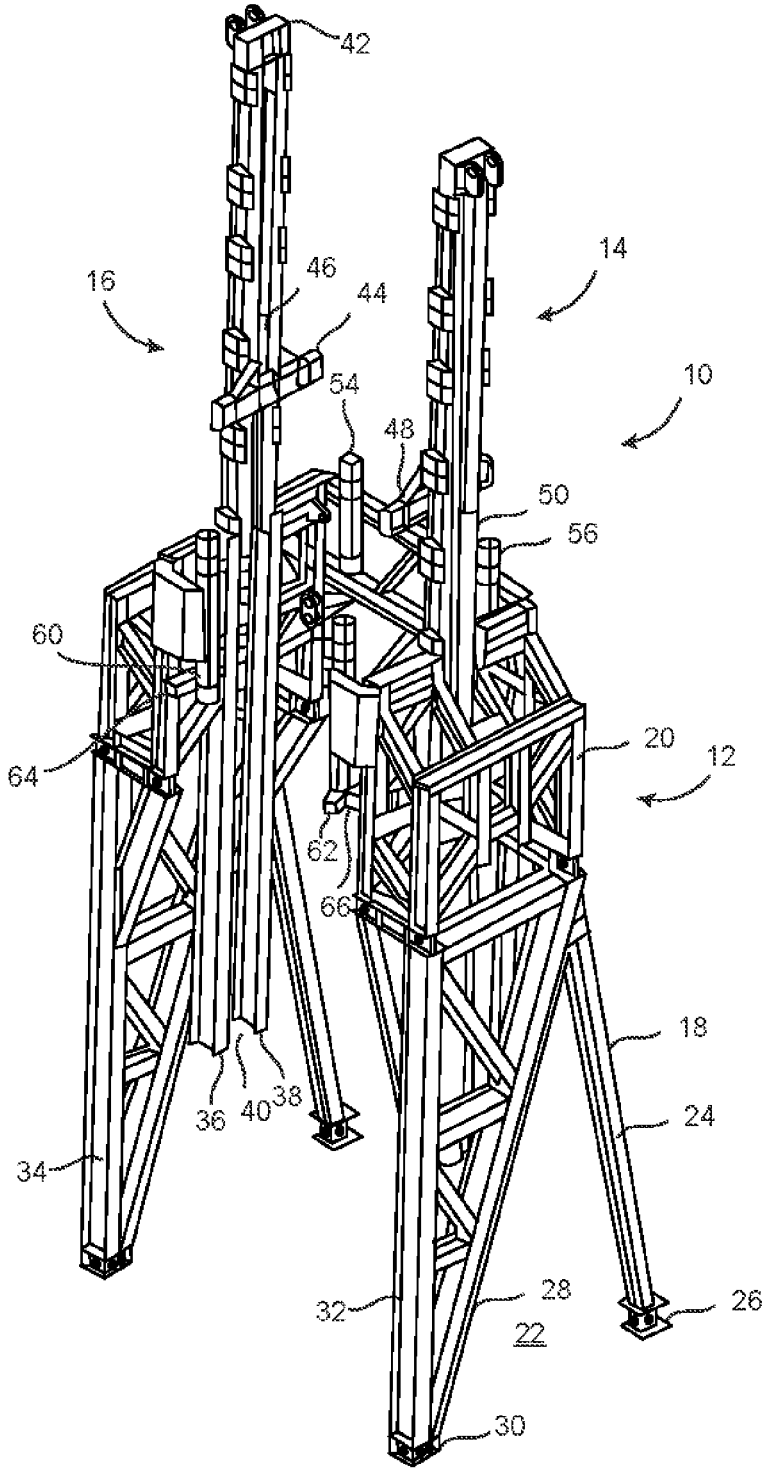
FIG. 1 is a perspective view of the apparatus of the present invention for forming the mast assembly.

Referring to FIG. 1, there is shown the apparatus 10 for the assembly of a mast for a drilling rig. The apparatus 10 includes a support structure 12, a first carriage assembly 14, and a second carriage assembly 16. The support structure 12 is formed of an A-frame 18 and a boot frame 20. The boot frame 20 is positioned over the A-frame 18. The first carriage assembly 14 and the second carriage assembly 16 are affixed to the boot frame 20.

In FIG. 1, it can be seen that the support structure 12 is positioned on a floor 22 of a drilling rig. The A-frame 18 has a leg 24 that extends at an angle outwardly. A shoe 26 is pivotally attached to the bottom end of the leg 24. Shoe 26 is a one hole shoe that can be affixed to the drilling rig. In normal use, during installation, the A-frame 18 will be pivoted about the shoe 26 so as to be located in a proper position. The other leg 28 of the A-frame 18 is connected to a shoe 30 at a bottom thereof. Shoe 30 is two-hole shoe. Shoe 30 will also be secured to the floor of the drilling rig. The boot frame 20 has a forward leg 32 that is pivotally connected to another hole of the shoe 30. As such, the pivotal connection of the leg 32 of the boot frame 20 to the shoe 30 will allow the boot frame 20 to be pivoted upwardly and over the A-frame 18. Legs 32 and 34 of the boot frame 20 define a forward opening for the support structure 12. The other legs of the A-frame 18 and the boot frame 20 are also connected to the floor 22 of the drilling rig in a manner described hereinbefore. The openings defined by the legs 32 and 34 allow the various sections of the mast assembly to be placed into the interior of the support structure 12, as will be described hereinafter.

In FIG. 1, it can be seen that the first carriage assembly 14 is affixed to the boot frame 20. The first carriage assembly 14 extends upwardly for a distance above the boot frame 20. As such, the first carriage assembly 14 can be suitable for elevating a section of the mast assembly above the floor 22 of the drilling rig.

The second carriage assembly 16 is assembled to the boot frame 20 in an identical manner to that in which the first carriage assembly 14 is assembled to the boot frame 20. In FIG. 1, it can be seen that the second carriage assembly 16 has a first I-beam 36 and a second I-beam 38. I-beams 36 and 38 are affixed to the support structure 12 so as to have an end 40 positioned a desired distance above the floor 22. The I-beams 36 and 38 extend upwardly so as to have an opposite end 42 positioned well above the boot frame 20 of the support structure 12. The I-beams 36 and 38 have channels that face each other. A lifting carriage 44 has guide member 46 that is received within the channel between the I-beams 36 and 38. The guide member 46 can slide upwardly and downwardly within the I-beams 36 and 38 through the respective channels. The lifting carriage 44 faces toward the lifting carriage 48 of the first carriage assembly 14. Since the lifting carriage 44 travels upwardly and downwardly along the I-beams 36 and 38, the lifting carriage 44, in combination with the guide member 46, assures a proper lifting of the mast section from the bottom 40 to the top 42 of the carriage assembly 16.

With respect to the first carriage assembly 14, a hydraulic drive cylinder 50 is positioned on a side of the I-beams opposite the lifting carriage 44. The drive cylinder 50 is connected to the guide member (such as guide member 46) between the I-beams of the first carriage assembly 14. As such, the drive cylinder 50 can serve to move the carriage 48 upwardly and/or downwardly. Each of the carriage assemblies 14 and 16 has an identical construction. As such, another drive cylinder (not illustrated) will be suitably connected to the guide member 46 and the lifting carriage 44 so as to achieve a corresponding movement to that of the lifting carriage 48 of the first carriage assembly 14.

The present invention is extremely safe. As will be described hereinafter, a mast section can be inserted into the interior of the support structure 12 through the forward opening. A pair of guide members 54 and 56 are affixed to the back surface of the support structure 12. Guide members 54 and 56 extend vertically and are in spaced relationship to each other. In normal use, channels associated with I-beams of the mast section will extend over these guide members 54 and 56. As such, when the mast section is installed into the interior of the support structure 12, the channels of the I-beams will extend over the guide members 54 and 56 so that the mast section is properly aligned for lifting.

The support structure 12 also includes extendable guide members 60 and 62. In FIG. 1, the extendable guide members 60 and 62 are in an elevated position. As such, they will not present an obstacle to the loading of the mast section into the interior of the support structure 12. Once the mast section is installed (as will be described hereinafter), the extendable guide members 60 and 62 will be moved downwardly so as to engage channels formed in the I-beams associated with the structure of the mast section. As such, the extendable guide members 60 and 62 will serve to retain the mast section on the interior of the support structure 12 and prevent any possibility that the mast section will fall outwardly therefrom. The extendable guide members 60 and 62 also used to assure that the mast section is properly aligned for lifting.

FIG. 1 shows that there are locking mechanisms 64 and 66 operatively connected to the support structure 12. As such, and as will be described hereinafter, when the final and bottommost mast section is elevated to its desired position above the floor 22, the locking mechanisms 64 and 66 will be urged inwardly so as to engage with lugs on the mast section. As such, the mast section can be supported in a secure manner above the floor 22. The locking mechanisms 64 and 66 will be described in greater detail hereinafter.

With reference to FIG. 1, it is important to note that the mast sections (that will be installed into the interior of the support structure 12) are secured in a strong manner. The carriage assemblies 14 and 16 retain the lifting carriages 44 and 48 in a strong and secure manner between the I-beams. Furthermore, the various guide members 54, 56, 60 and 62 assure that the mast section is oriented properly and will not move from the desired position. As such, alignment and security are assured.

Figure 2:
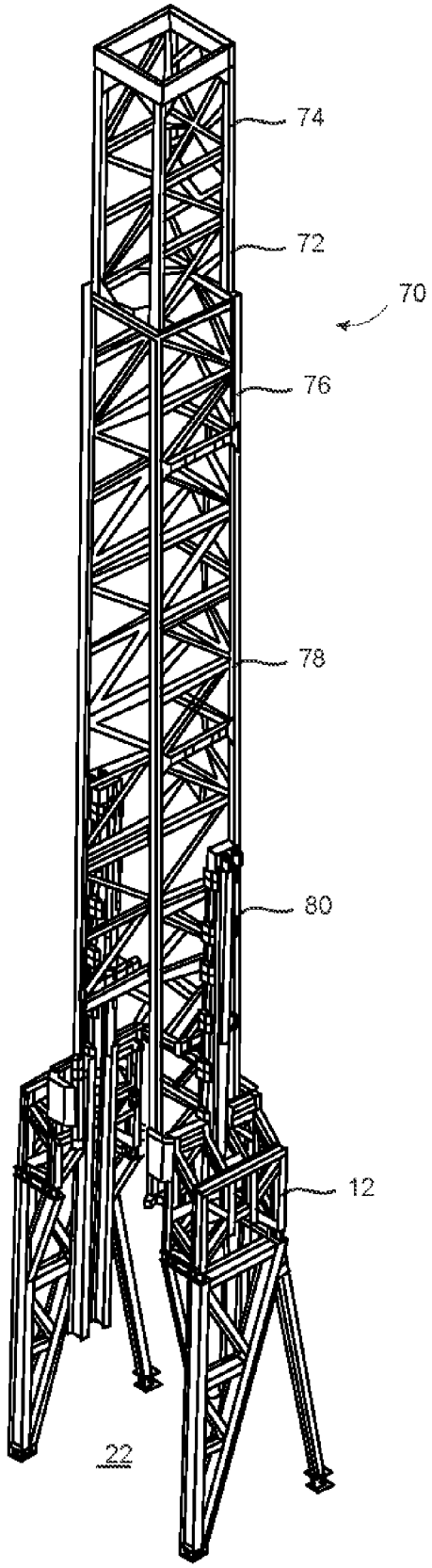
FIG. 2 is an upper perspective view showing the completely assembled mast assembly of the present invention.

FIG. 2 shows the assembled mast sections of the rig 70. In particular, it can be seen that there is a crown mast section 72 at an upper portion thereof. The crown mast section 72 is formed of a first box structure 74 supported on a second box structure 76. The box structures 74 and 76 are secured together prior to installation. The upper portion of the crown mast section 72 can support a crown block thereon. A middle mast section 78 is secured to the crown mast section 72. As such, the crown mast section 72 is affixed in end-to-end relationship with the mast section 78. The lower mast section 80 is affixed to the bottom of the mast section 78. The mast section 80 is also secured to the support structure 12 at a bottom end thereof. The bottommost mast section 80 is positioned so that the bottom thereof is elevated above the floor 22 of the rig. The support structure 12 should be strong enough so as to support the mast sections 72, 78 and 80 in their vertically aligned orientation. Since the mast sections 72, 78 and 80 are connected in end-to-end relationship and directly above one another, all of the mast sections 72, 78 and 80 are supported in compression. As such, the present invention is able to achieve a strong and sturdy construction with a minimal amount of steel. The elevation of the mast sections 72, 78 and 80 above the floor 22 allows for a large amount of area in which workers can properly carry out the necessary drilling activities. The carriage assemblies enhance the stability of the assembled mast 70. As can be seen, the mast assembly 70 has a relatively small footprint with respect to the drill floor 22.

Figure 3A:
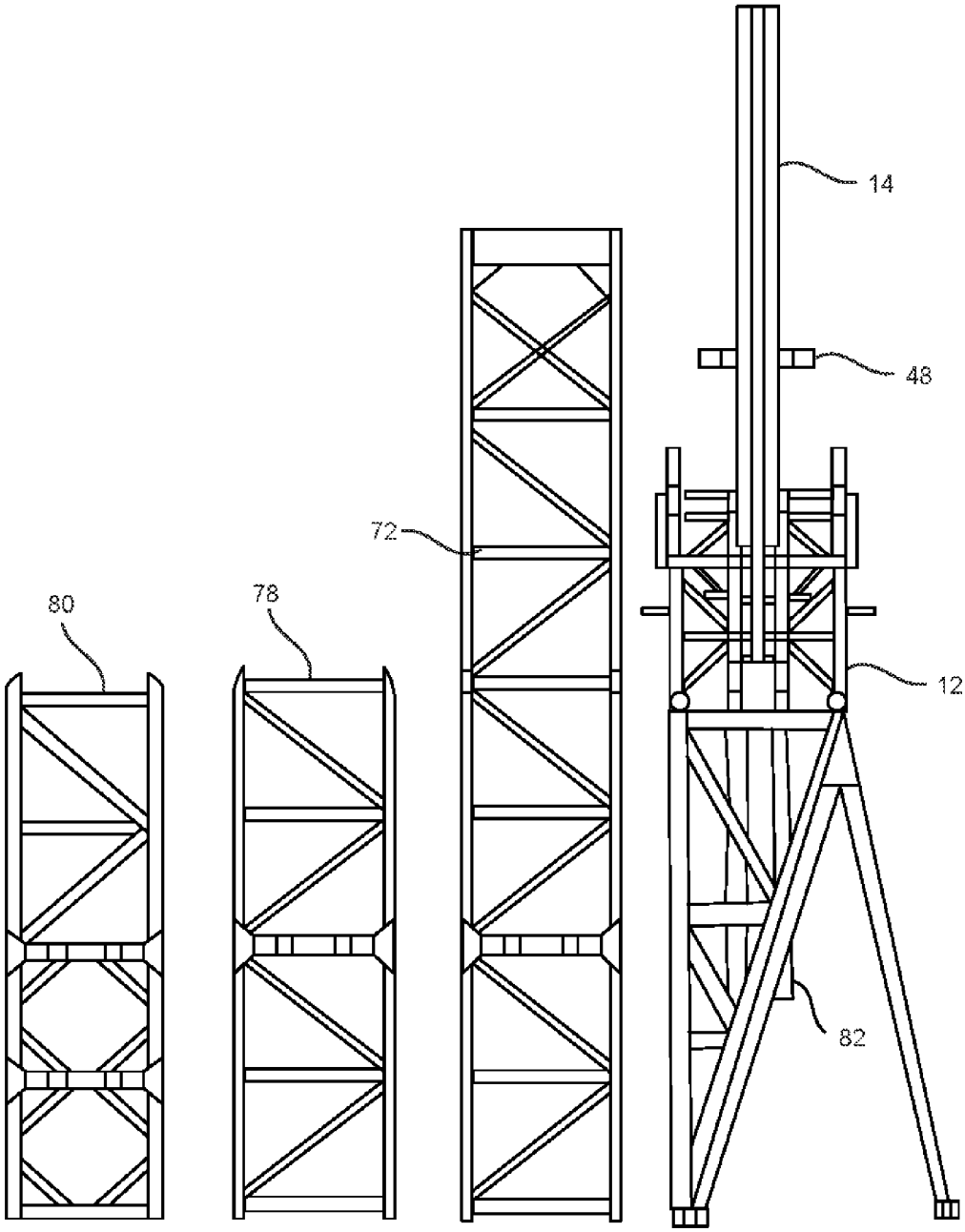
FIGS. 3A-3D show the sequence of operations of the method of the present invention for forming the mast assembly.

FIG. 3A shows the first step in the assembly of mast 70. It can be seen that the support structure 12 is positioned upon the drilling floor and extends upwardly therefrom. The first carriage assembly 14 is illustrated as extending upwardly of the support structure 12. The first carriage assembly 14 has a bottom end 82 that is positioned a distance above the floor 22. The lifting carriage 48 is shown in a suitable position for lifting the mast sections. The crown mast section 72 is positioned adjacent to the support structure 12. The middle mast section 78 is positioned next on a side of the crown mast section 72 opposite the support structure 12. Finally, the bottom mast section 80 is positioned on a side of the middle mast section 78 opposite the crown mast section 72. The mast sections 72, 78 and 80 are now arranged for installation into the support structure 12 and arranged for the purpose of lifting and assembly.

Figure 3B:
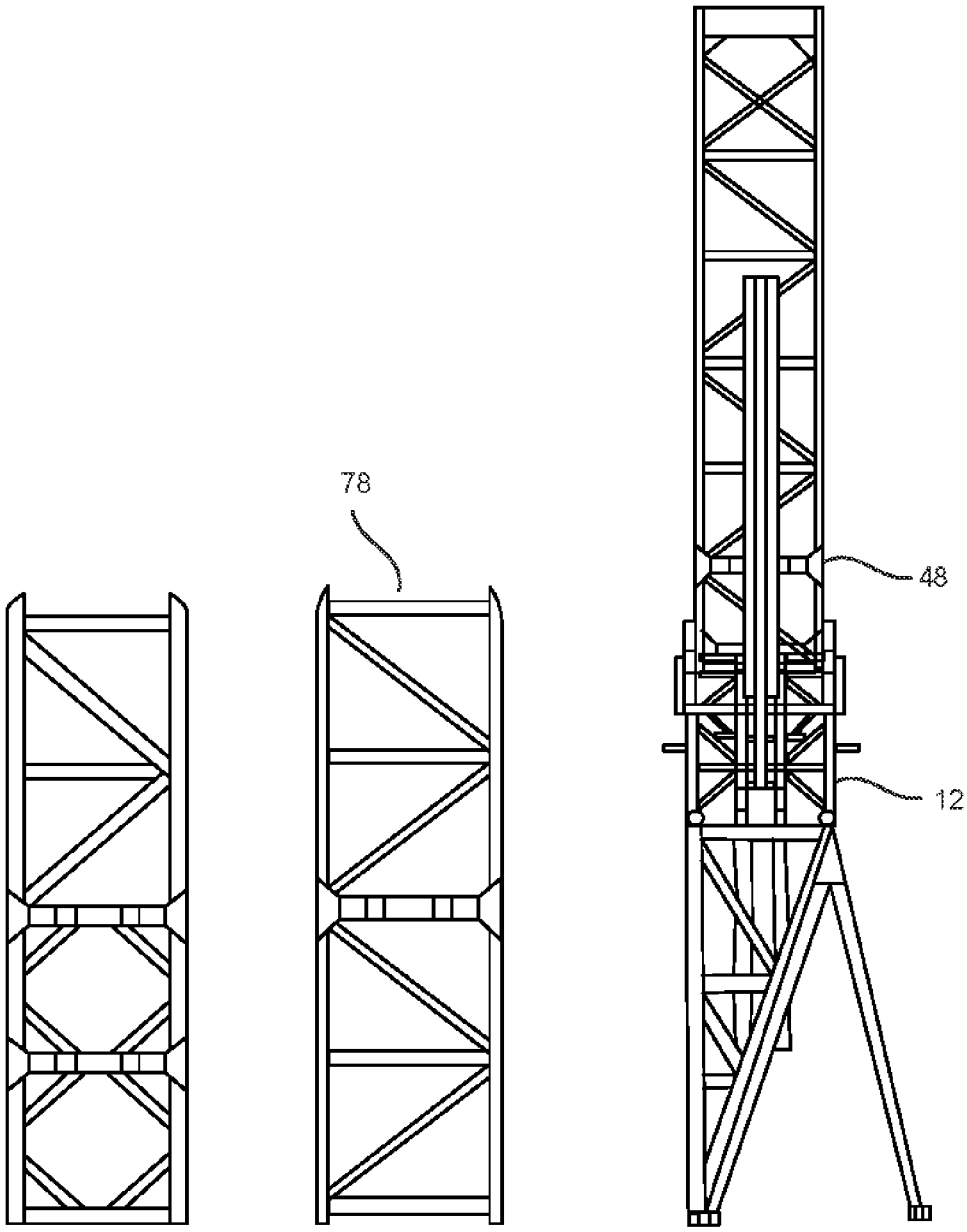

In FIG. 3B, it can be seen that the crown mast section 72 has been inserted into the forward opening of the support structure 12. The lifting carriage 48 is affixed to a surface of the crown mast 72. In this position, the crown mast 72 has been elevated for a distance above the rig floor by the lifting carriage 48. The lifting carriage 48 will now retain the crown mast 72 in an elevated position prior to the installation of the middle mast section 78.

Figure 3C:
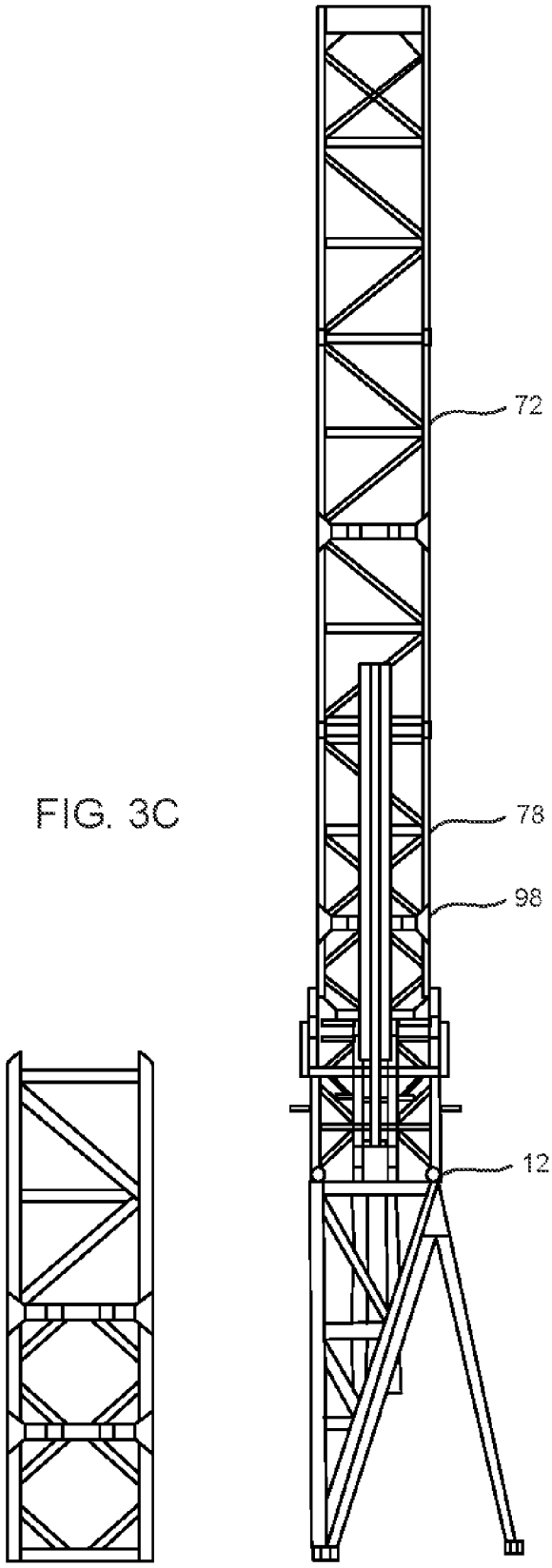

FIG. 3C shows that the middle mast section 78 has been installed and connected to the crown mast section 72. In other words, the middle mast section 78 has been inserted into the front opening of the support structure 12. The lifting carriage 48 is released from the crown mast section 72. Since the crown mast 72 is now supported by the top of the middle mast section 78 within the support structure 12, the crown mast 72 does not need to be retained by the lifting carriage 48. Prior to release of the lifting carriage 48 from the crown mast 72, suitable pins can be inserted so that the bottom of the crown mast 72 is secured to the top of the middle mast section 78. The lifting carriage 48 can then be moved downwardly and engaged with the middle mast section 78. The lifting carriage 48 can now be moved upwardly so as to elevate the middle mast section 78 and the crown mast 72 a desired distance above the rig floor.

Figure 3D:
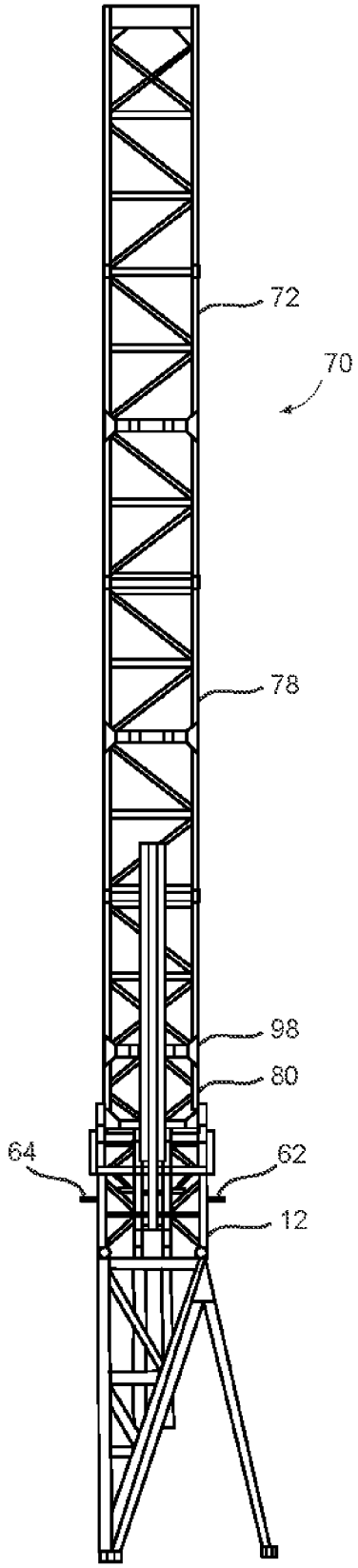

FIG. 3D shows the final step in the assembly process. In FIG. 3D, it can be seen that the lower mast section 80 has been installed at the bottom of the middle mast section 78. The crown mast 72 remains supported by the middle mast section 78. With reference to FIG. 3C, the middle mast section 78 is inserted into the front of the support structure 12 and installed in the manner described herein previously. The lifting carriage 48 can move the middle mast section 78 slightly downwardly so that the bottom of the middle mast section 78 abuts the top of the lower mast section 80. In this position, pins can be installed so as to fixedly secure the middle mast section 78 to the lower mast section 80. The carriage 48 can then be released from the middle mast section 78 and moved downwardly. The carriage is then engaged with the lower mast section 80. The drive cylinder can be actuated so as to move the middle mast section 78 to a position above the rig floor 22. When the lower mast section 80 is in a proper position above the rig floor, the locking mechanisms 62 and 64 can be actuated so as to lock the lower mast section 80 to the support structure 12. As such, the assembly is completed. For security, the lifting mechanism 48 can remain connected to the lower mast section 80. As such, the mast 70 is completely assembled. The remaining components of the oil rig can then be installed so that the drilling activities can occur.

Figure 4:
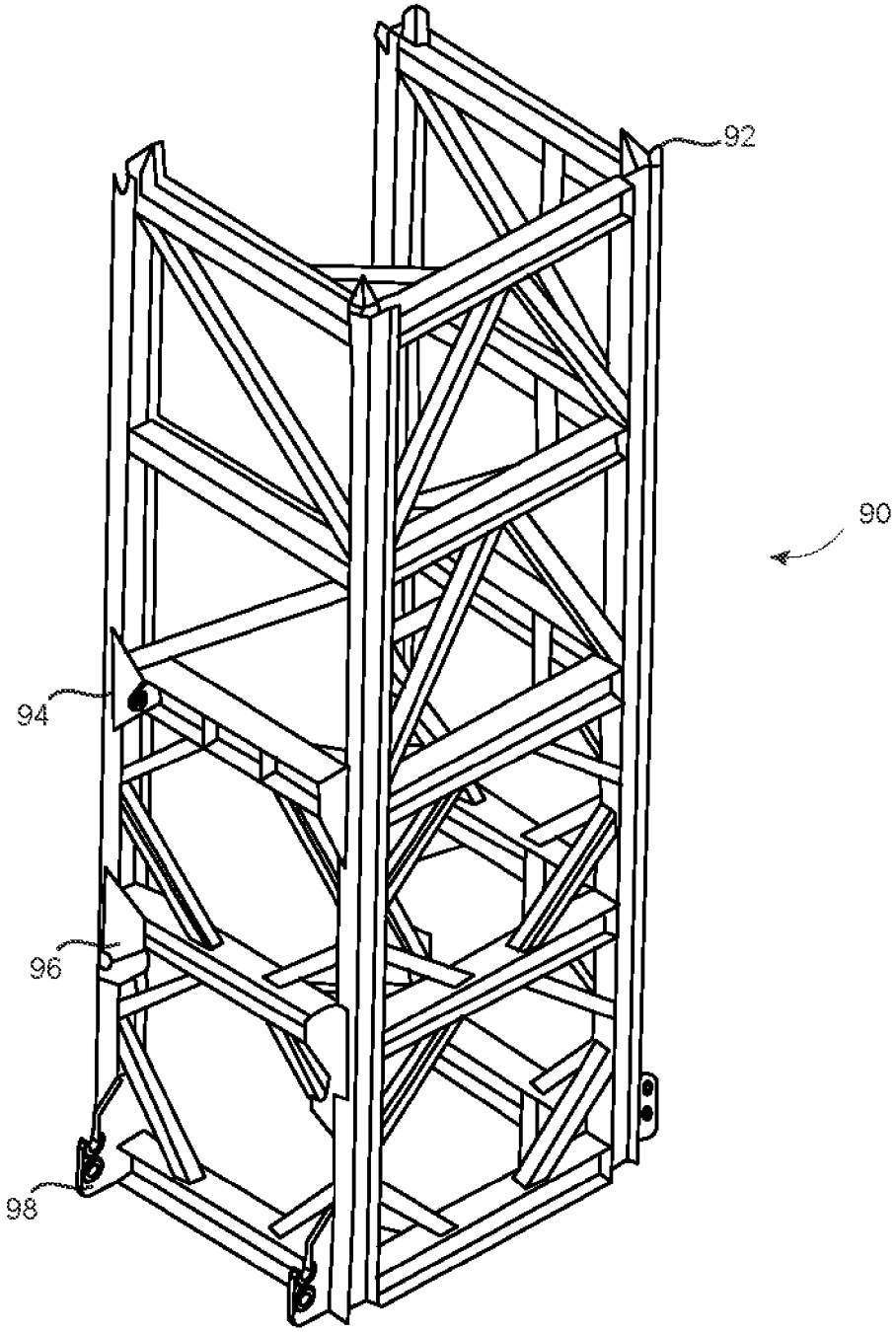
FIG. 4 is a perspective view of a single section of the mast assembly.

FIG. 4 shows details of the structure of a single mast section 90. It can be seen that the mast section 90 has a generally box-type structure. A suitable framework is defined throughout the mast section 90. The framework is designed so as to ensure the maximum structural integrity of the mast section 90. It is known in the prior art to be able to build such strong box-like structures. The mast section 90 includes an upper end 92 that is suitable for engagement with the bottom of another mast section. Suitable projecting pins can be utilized so as to properly connect the mast sections together. A lug 94 is formed on the sides of the mast section 90. The elevating carriage lug is suitable for engagement with the lifting carriage 48. As such, the lifting carriage 48 is generally secured adjacent to the center of the length of the mast section 90. A stabilizer lug 96 is positioned on the side of the mast section 90 below the elevating carriage lug 94. A mast lock shoe 98 is positioned at the bottom of the mast section 90. The mast lock shoe 98 is suitable for locking engagement with the locking mechanism associated with the support structure 12. It should be noted that the elevating carriage lug 98, the stabilizer lug 96 and the mast lock shoe 98 are formed on each of the I-beams on the sides of the mast section 90.

Figure 5:
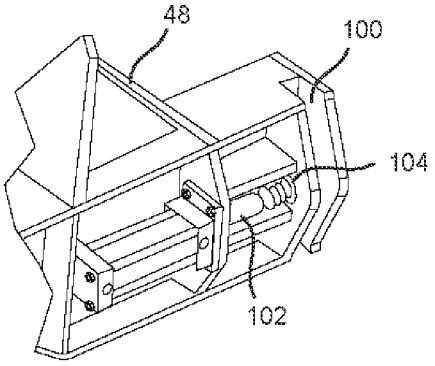
FIG. 5 is a detailed view of the pin actuator on the carriage.

FIG. 5 is a detailed view of the pin actuator on the carriage 48. It can be seen that a channel 100 is formed on the carriage 48. Channel 100 has suitable holes formed therein which align with the holes on the elevating carriage lug 94 of the mast section 90. As such, the lug 94 will be received within the channel 100 of the carriage 48. A pin actuator 102 is positioned on the lifting carriage 48. The pin actuator 102 has a pin 104 that is in a position away from the channel 100. When the lug 94 is received within the channel 100, a suitable signal can cause the pin actuator 102 to move the pin 104 through the holes of the channel 100 and the lug 94 so as to releasably secure the carriage 48 to the lug 94. After installation of the mast section 90 is completed, the pin actuator 102 can withdraw the pin 104 from its engaged relationship between the lug 94 and the channel 100.

Figure 6:
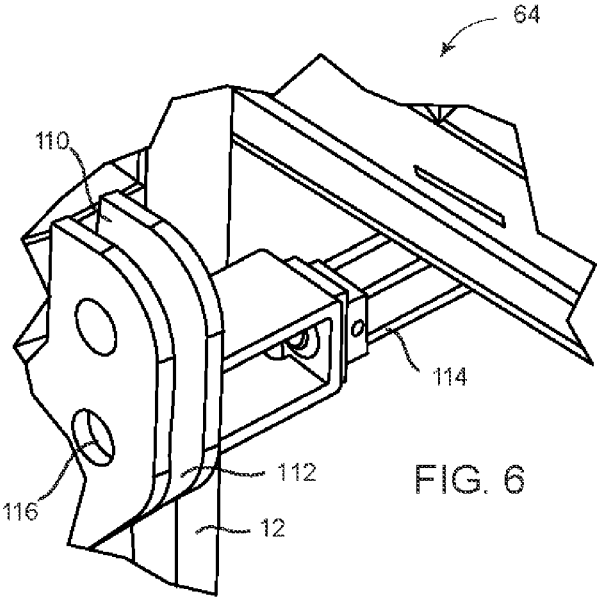
FIG. 6 is a perspective view, in detail, of the locking shoe for the pin actuator.

FIG. 6 is detailed view of the locking mechanism 64. The locking mechanism 64 is intended to lock the lower mast section 80 to the support structure 12. In particular, a shoe 110 is affixed to the support structure 12 so as to define a channel 112 within the shoe 110. An actuator 114 is positioned to the shoe 110. The actuator 114 is suitable for placing a pin through the channel 100 and outwardly so that a portion extends through the hole 116. In normal use, when the mast lock shoe 98 of the mast section 90 is placed in the channel 112, the actuator 114 will drive a bolt or pin so as to fixedly secure the shoe 98 within the channel 112 so that the mast section 90 is fixedly locked with respect to the support structure 12.

Figure 7:
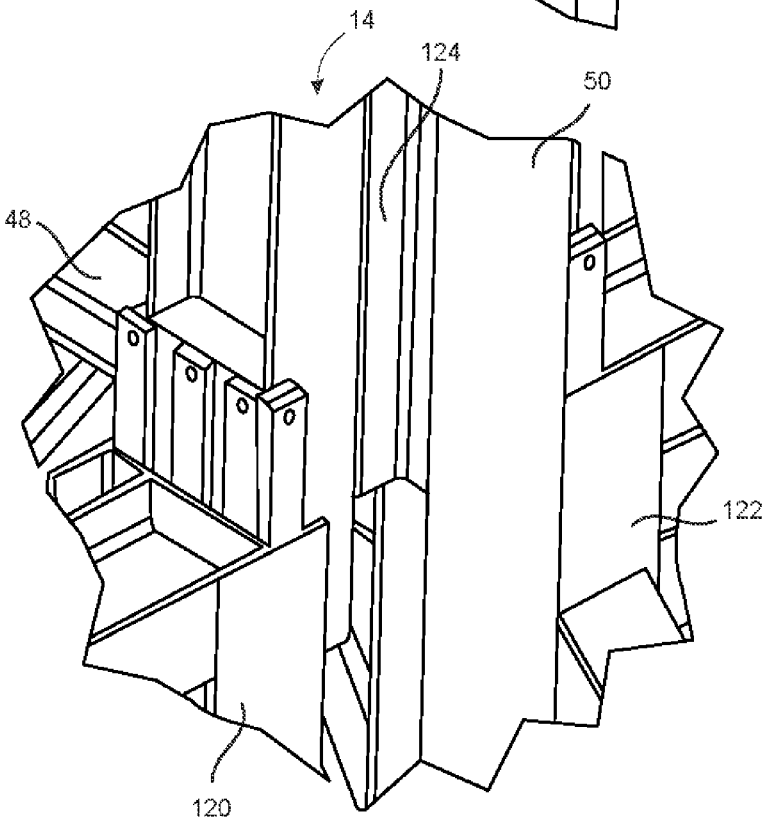
FIG. 7 is a detailed perspective view of the carriage assembly as received between I-beams on the support structure.

FIG. 7 shows a detailed view of the carriage assembly 14. In FIG. 7, the drive cylinder 50 is particularly illustrated as located on the backside of the I-beams 120 and 122. A guide member 124 is received within the channels of the I-beams 120 and 122. As such, the guide member 124 can slide through the channels of the I-beams 120 and 122. The lifting carriage 48 extends outwardly the guide member 124.

Figure 8:
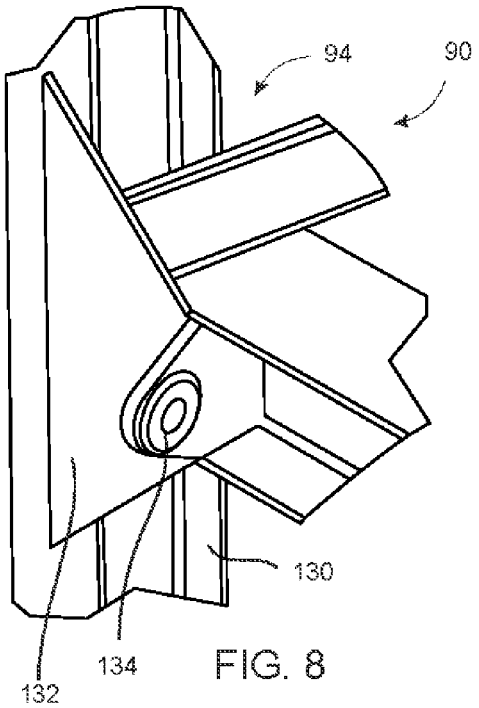
FIG. 8 is a detailed perspective view of the lug on the mast section that connects to the carriage.

FIG. 8 shows the elevating carriage lug 94 in detail. The elevating carriage lug 94 is affixed to the structural framework 130 of the mast section 90. The elevating carriage lug 94 includes a flange member 132 that extends outwardly. A hole 134 is formed on the flange 132. Hole 134 will correspond in location with the channel 100 of the carriage lock. As such, the carriage can be secured to the elevating carriage lug 94.

Figure 9:
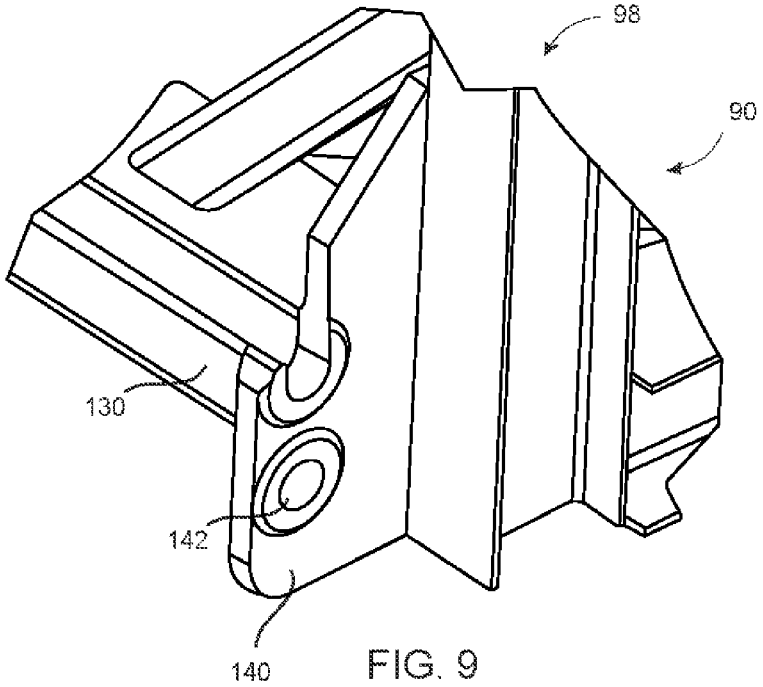
FIG. 9 is a perspective view of the shoe on the mast section that locks the mast section on the support structure.

FIG. 9 is a detailed view of the mast lock shoe 98. The mast lock shoe 98 includes a flange 140 that extends outwardly of the frame structure 103 for the mast section 90. The flange 140 includes a suitable hole 142 through which the bolt of the support structure 12 can be secured thereto. As such, the bottom of the mast section 90 can be fixedly secured to the top of the support structure 12.

Figure 10:
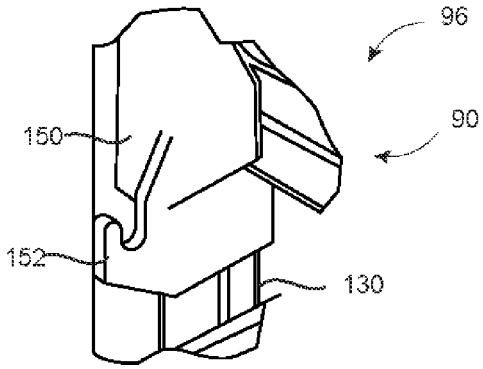
FIG. 10 is a detailed view, in perspective, of the stabilizer lug on the mast section.

FIG. 10 is a detailed view of the stabilizer lug 96 on the mast section 90. The stabilizer lug 96 includes a flange surface 150 that extends outwardly of the framework 130 of the mast section 90. A small hook 152 is formed on the flange 150 and extends outwardly therefrom.

Figure 11:
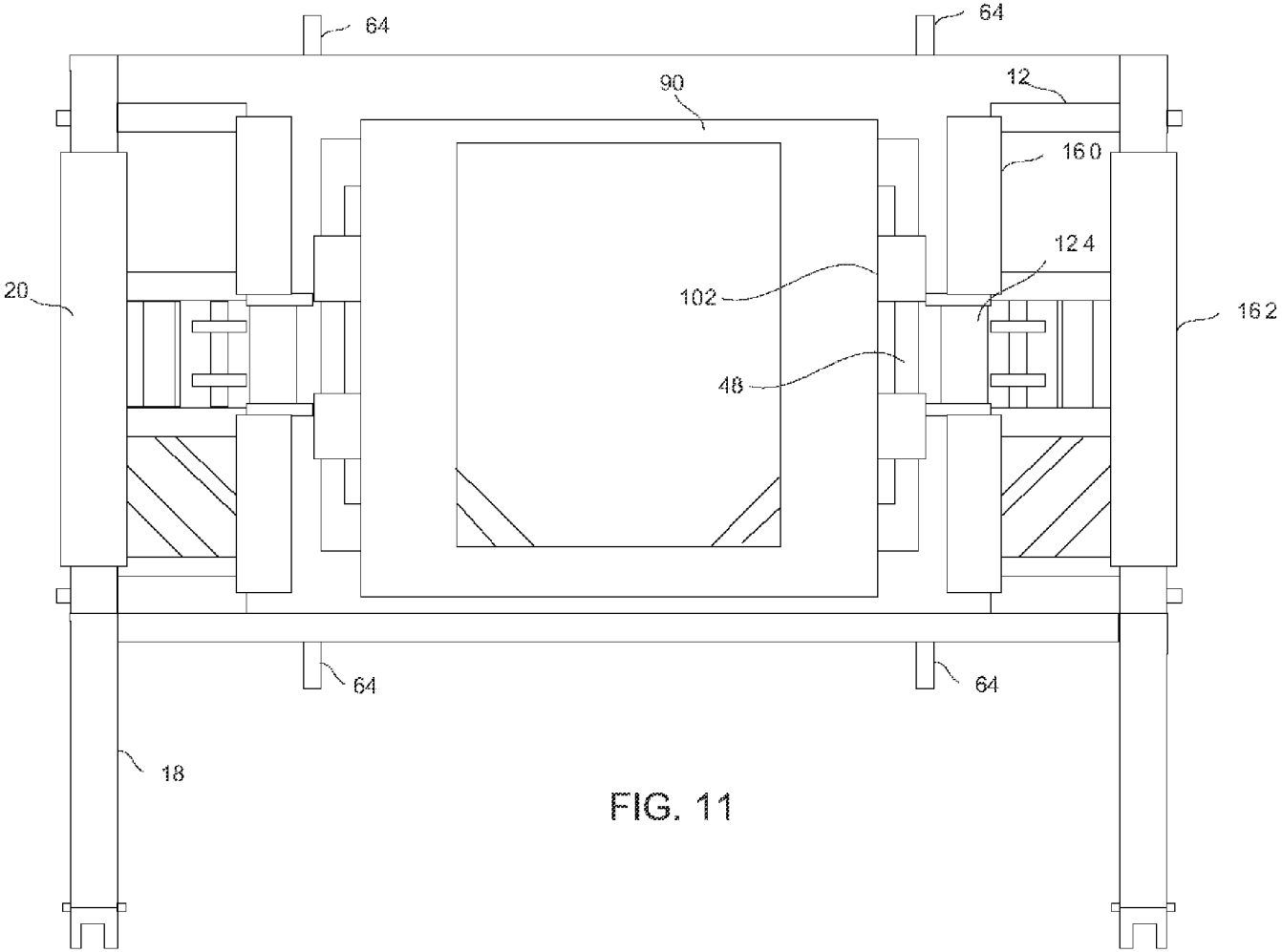
FIG. 11 is a plan view of the completed mast assembly of the present invention.

FIG. 11 is a plan view showing the mast assembly 90 as positioned within the support structure 12. The support structure 12 includes a boot frame 20 that is affixed to the A-frame 18. The boot frame 20 includes a cross member 160 extending across the generally square frame of the boot frame 20. The cross member 160 includes I-beams located centrally between the side of the boot frame 20. The guide member 124 is illustrated as being received between the I-beams of the cross member 160. A trunnion 162 secures the guide member 124 to the drive cylinder 50. It can be seen that the guide member 124 is securely positioned in slidable relation within the channels of the I-beams. The lifting carriage 48 is connected to the guide member 124 such that the drive cylinder can move the lifting carriage 48 upwardly and downwardly. The pin actuator 102 is positioned on an inner surface of the lifting carriage 48. The pin actuator 102 can be actuated so as to engage with the lugs formed on the outer surface of the mast section. The locking mechanism 64 is illustrated as positioned on opposite side of the boot frame 20. The locking mechanism 64 can have a wide variety of configurations. In particular, the locking mechanism 64 can be in the form of bolts that are driven so as to fixedly secure the lower mast section to the support structure 12. Other types of mechanisms, such as pin connections, screw connections, or other types of mechanisms can also be employed. The use of four locking mechanisms will provide additional security and stability to the mounting of the mast section 90 within the interior of the support structure 12.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

We claim:

1. An apparatus for forming a mast assembly upon a floor of a drilling rig comprising:

a support structure having a back surface and an opening;

a first carriage assembly affixed to one side of said support structure, said first carriage assembly having a first carriage with a drive cylinder connected thereto so as to move said first carriage between a first lower position and a first upper position; and a second carriage assembly affixed to an opposite side of said support structure, said second carriage assembly having a second carriage with a drive cylinder connected thereto so as to move said second carriage between a second lower position and a second upper position, said first and second carriage assemblies suitable for a connection to a section of the mast assembly, each of said first and second carriage assembly comprising:

an elongated beam assembly extended vertically so as to have an upper end positioned above said support structure and a lower end positioned in spaced relation above the floor, said elongated beam assembly comprising:

a first I-beam having a channel formed longitudinally therein; and a second I-beam having a channel formed longitudinally therein, said first and second I-beams being affixed to said support structure such that the respective channels thereof face each other.

2. The apparatus of claim 1, said support structure comprising:

an A-frame suitable for connection to the floor of the drilling, rig; and a boot frame positioned over said A-frame, said first and second carriage assemblies being affixed to said boot frame.

3. The apparatus of claim 1, further comprising:

a first guide member affixed to said back surface of said support structure, said first guide member suitable for receiving a channel of the mast assembly thereover, said first guide member extending vertically.

4. The apparatus of claim 3, further comprising:

a second guide member affixed to said back surface of said support structure, said second guide member extending vertically in spaced relation to said first guide member, said second guide member suitable for receiving another channel of the mast assembly thereover.

5. The apparatus of claim 1, further comprising:

an extendable guide member positioned adjacent said opening of said support structure, said extendable guide member for sliding into a channel of the mast assembly so as to retain the mast assembly within an interior of said support structure.

6. The apparatus of claim 1, each of said first and second carriage assemblies further comprising:

a guide block having ends slidably received in the channels of said first and second I-beams, the drive cylinder being connected to said guide block; and a lifting carriage affixed to said guide block, and positioned outwardly of said first and second I-beams, said lifting carriage suitable for connection to a section of the mast assembly.

7. The apparatus of claim 6, said lifting carriage comprising:

a pin actuator affixed to said lifting cylinder, said pin actuator being suitable for moving a pin in a direction for connecting to the section of the mast assembly.

8. The apparatus of claim 1, further comprising:

a locking means affixed to said support structure for locking the mast assembly to the support structure in an elevated position above the floor of the drilling rig.

* * * * *